United States Patent [19]

Dahlback

[11] Patent Number: 4,820,084

[45] Date of Patent: Apr. 11, 1989

[54] DEVICE FOR HEAT-INSULATED DIVING SUITS FOR WORK AT GREAT DEPTHS UNDER WATER

[75] Inventor: Gunnar Dahlback, Linkoping, Sweden

[73] Assignee: Advanced Underwater Techology, Goteborgs, Sweden

[21] Appl. No.: 84,791

[22] PCT Filed: Nov. 12, 1986

[86] PCT No.: PCT/SE86/00532

§ 371 Date: Jul. 28, 1987

§ 102(e) Date: Jul. 28, 1987

[87] PCT Pub. No.: WO87/03262

PCT Pub. Date: Jun. 4, 1987

[30] Foreign Application Priority Data

Nov. 28, 1985 [SE] Sweden ..... 8505614

[51] Int. Cl.[4] ..... B63C 11/02

[52] U.S. Cl. ..... 405/186; 128/202.11

[58] Field of Search ..... 405/185, 186; 128/201.25, 201.27; 126/210, 208

[56] References Cited

U.S. PATENT DOCUMENTS

| | | | |
|---|---|---|---|
| 1,327,679 | 1/1920 | Leavitt | 285/158 X |
| 3,343,536 | 9/1967 | Brisson et al. | 128/202.11 |
| 3,345,641 | 10/1967 | Jennings | 128/202.11 X |
| 3,528,414 | 9/1970 | Schueller | 128/202.11 |
| 3,635,216 | 1/1972 | Curtis | 128/202.11 |
| 3,667,460 | 6/1972 | Shepard | 128/202.11 X |

FOREIGN PATENT DOCUMENTS 1514310 6/1978 United Kingdom .

OTHER PUBLICATIONS

Navy Technical Disclosure Bulletin, vol. 5, No. 5, May 1980, Peter S. Riegel, "Closed-Circuit Underwater Breathing Apparatus", (Navy Tech. Cat. No. 7740; Navy Case No. 63671).

*Primary Examiner*—Dennis L. Taylor

*Attorney, Agent, or Firm*—Cushman, Darby & Cushman

[57] ABSTRACT

A device for a heat-insulated diving suit (14) for work under water at great depths, including a helmet (11), which is connected to a breathing apparatus (15) with a substantially closed respiration circuit. The object is always to supply the diver, even in emergency situations when the connection to the substantially closed repiration system is cut off, with warm breathing gas. The respiration system is constructed so that the diver, for short periods, can survive without external energy and gas supplies. The breathing circuit of the breathing apparatus (15) is largely integrated with the diving suit (14) and arranged within its heat-insulation.

6 Claims, 3 Drawing Sheets

DEVICE FOR HEAT-INSULATED DIVING SUITS FOR WORK AT GREAT DEPTHS UNDER WATER

BACKGROUND OF THE INVENTION

The present invention relates to a device for heat-insulated diving suits for underwater work at great depths, and including a helmet, which is connected to a breathing apparatus with a mainly closed respiration circuit.

Routinely, at the present time, divers are used in connection with work under water down to approximately 200 meters. There is a desire to enable work at even greater depths, e.g. down to about 450 meters, but at these depths, among a lot of other things, the great pressure leads to a result that the breathing gas becomes inert to breath, it also takes a large amount of heat to heat the gas if it is cold. The gas consumption increases and it is essential that the input gas partial pressure be kept within close ranges.

To overcome these problems, different ways to regulate the oxygen partial pressure in the breathing circuit have been suggested, whereby the diver, through conduits, is connected to an observation chamber or the like, where a measuring device continuously measures the partial pressure of the oxygen and, independent of this measuring, supplies a oxygen-rich gas compound to the diver's breathing circuit. The system requires a relatively complicated oxygen sensitive electronic equipment, which must function under normal pressure- and humidity conditions and it therefor can not be included in the diver's own personal equipment.

Present-day breathing systems are often so-called open systems of "demand"-type, in which the already-prepared gas is inhaled thereupon to be exhaled, directly into the water. In order to save gas when diving at great depths, the so called "reclaim system" is also used, in which exhaled gas is collected, which is sucked, or, due to the pressure difference flows, to a diving-bell or to a vessel on the surface, where it is purified and then pumped back to the diver. Such a system, with its pumps and hoses, becomes both space and energy demanding, as it has no natural, built-in emergency system, if the "umbilical cord" should break. A gas bottle on the back of the diver connected to this system gives emergency breathing time of only about 30 seconds down at 450 meters depth, which is quite insufficient.

Through U.S. Pat. No. 3,345,641 there is earlier known a ventilated space suit, having on the outside a portable breathing apparatus which includes a closed respiration system, in which oxgenized air is allowed to circulate within the entire space suit, for transporting humidity from the body to a dehumidifier provided outside the suit. Through the respiration system, in which the gas is purified remove carbon dioxide, in an absorber, much better gas economy can be achieved via considerably simplier techniques than earlier known systems, but a breathing equipment for a space suit works under completely other conditions than corresponding equipment for a diving suit, since the pressure at a water depth of 450 meters is about 100 times as large as the pressure maintained in a space suit.

To prevent the diver from freezing to death, it has become essential, that, beside an active heating of the suit, also there is provided a heathing of the breathing gas, when diving down to depths below 150–200 meters. Upon the occurrence of an interruption on the "umbilical core", when also the energy supply is shut off, the diver rapidly becomes frozen stiff if an efficient emergency system can not be turned on.

SUMMARY OF THE INVENTION

The purpose of the present invention is to produce a diving suit and breathing apparatus which, even in an emergency situation, when the connection with the depotship or the like is cut off, gives the diver heated breathing gas, simultaneously, since the respiration system is designed so that the diver can survive without external energy- and gas supplies, during a sufficient interval, e.g. 10–15 minutes, which is a reasonable time in an emergency situation. These problems have been solved by providing that the respirator circuit of the breathing apparatus, to considerable extent, is intergrated with the diving suit and arranged within the heat-insulation thereof.

BRIEF DESCRIPTION OF THE DRAWINGS

The invention, in the following, will be further described with refernece to the accompanying drawings, which illustrate an embodiment.

DETAILED DESCRIPTION OF A PREFERRED EMBODIMENT

Figure 1:
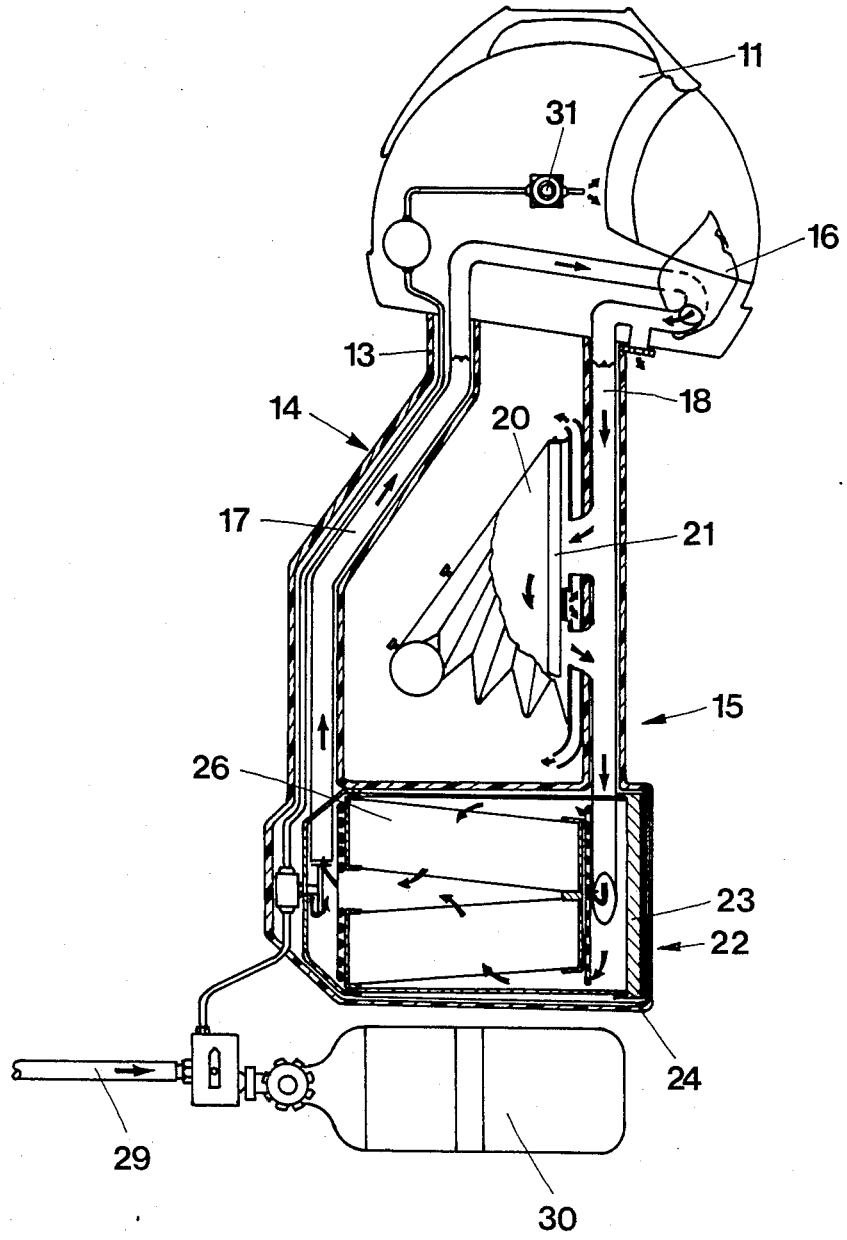
FIG. 1 shows, schematically, partly in right side elevation and partly in section, the helmet and breathing apparatus of a heat-insulated diving suit embodying principles of the present invention (the carbon dioxide absorber and emergency gas container, for convenience in illustration, being shown in section and in elevation, respectively, from the rear).
Figure 2:
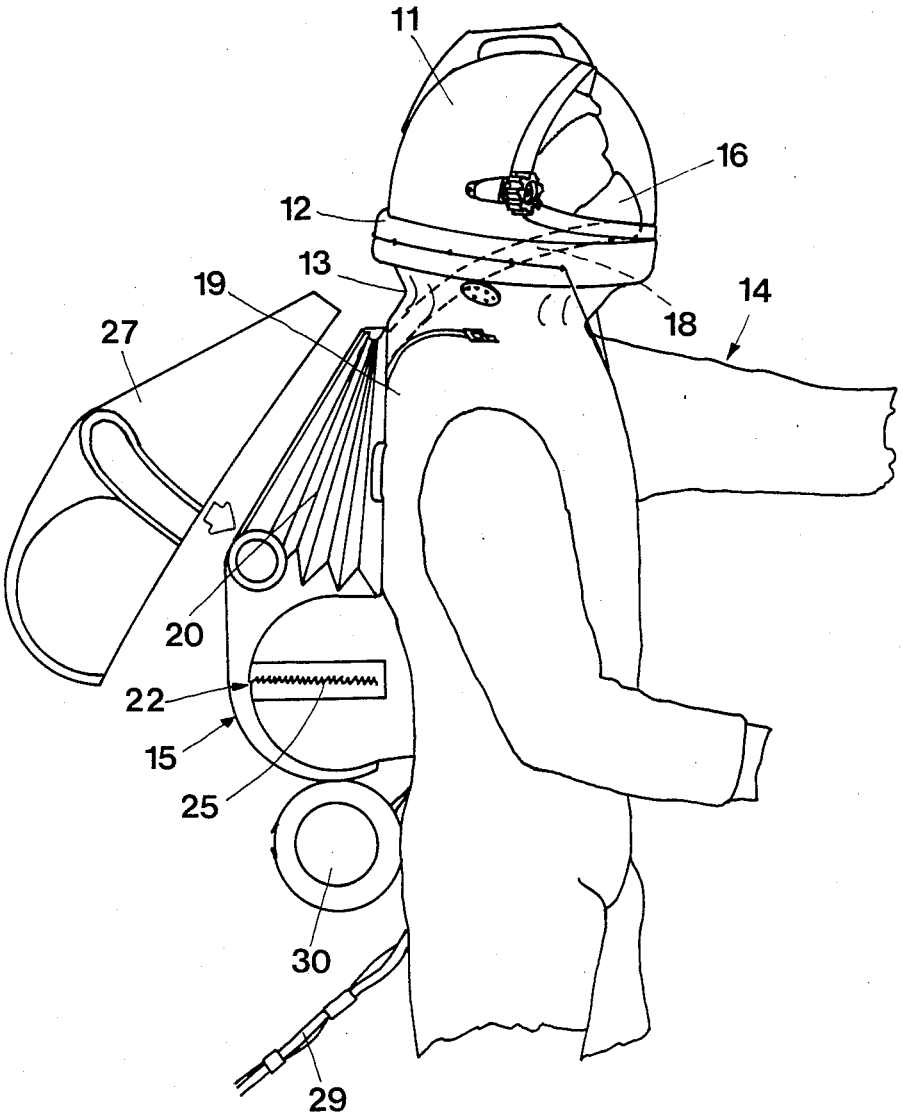
FIG. 2 shows, in perspective looking towards the right side, a complete diving device according to the invention (the removable cover for a major portion of the device being shown dismounted, to expose internal details)
Figure 3:
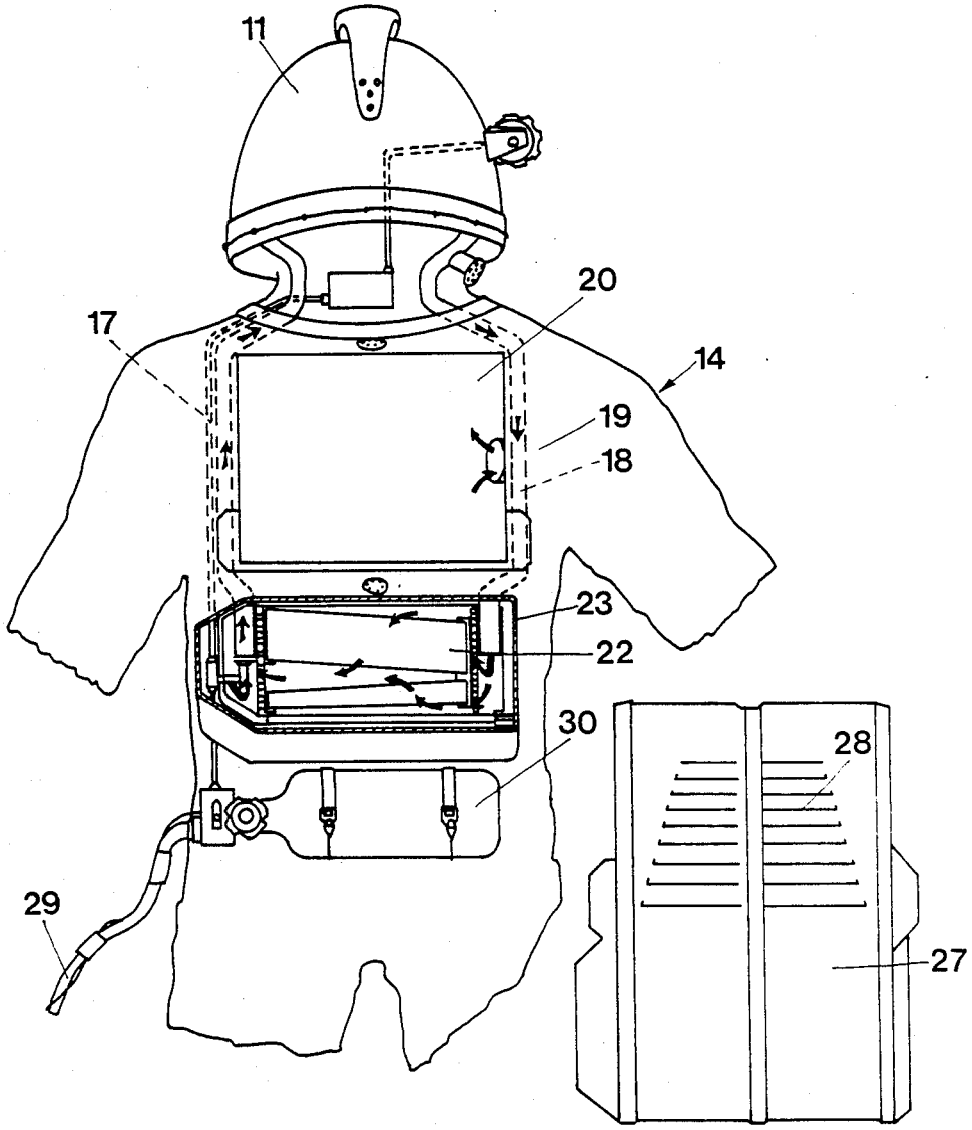
FIG. 3 shows, likewise in perspective, the diving device of FIG. 2, from behind, with the protecting cover removed, and the absorber in section.

The diving shown in FIGS. 1–3, is in many respects, is a conventional suit consisting of a removable helmet 11, which, via a helmet plate 12 and a neckband 13, continues into an overalls-type diving suit 14, which is on the inside, provided with a highly efficient heat-insulation.

The breathing apparatus 15 of the diving suit comprises a breathing mask 16, from which extends an inhaling hose 17 and an exhaling hose 18, within the helmet 11. The breathing hoses 17 and 18 are arranged within the neckband 13 and preferably arranged in and along the inner side of the back section 19 of the heat-insulated diving suit in such a manner, that the hoses absorb body heat from the diver, and optionally, heat from the active heating of the suit (if active heating is provided), but is prevented from emitting the absorbed heat through the thermal insulation of the diving suit. On the outside of the suit is fixedly arranged a breathing bellows 20, which, via a heat exchanger 21, is connected to the exhaling hose 18 within the suit. Below the breathing bellows 20 is arranged a carbon dioxide absorber 22 comprising a container 23 completely surrounded by a heat-insulation layer which forms part of the diving suit. The heat-insulating cover 24 surrounding the container 23 can be opened by means of a closing device e.g. a zipper 25, so that the absorption cartridge 26 in the container 23, can be changed. The breathing bellows 20, as well as the carbon dioxide absorber 22, are surrounded by a removable cover 27, which, on the inside, can be heat-insulated and provided with perforations 28, enabling water, from the body of water in which the diver is submerged, to flow in and out concurrently with the breathing. As seen in FIG. 1, on one side of the absorption cartridge is connected an exhalation hose 18, to the container 23, whereas to the opposite side of the cartridge there is connected an inhalation hose 17. The inhalation and the exhalation hoses are connected to a mask or a mouthpiece within the helmet. If the ordinary gas supply system should break down, fresh air can be manually portioned into the mask or to the mouthpiece through the free-flow valve 32. This valve is supplied with gas via an ordinary gas conduit 29 from the breathing apparatus, or from the emergency gas container 30.

The portions of the breathing circuit which are situated inside or within the diving suit, respectively, are so arranged, that these parts, i.e. mainly the inhaling and exhaling hoses 17 and 18, are heated by an active heating system of the suit, which system can consist of electrical threads or a warmwater system, the hoses of such warm water heating system being arranged in parallel with the inhaling and exhaling hoses 17, 18.

Because a larger part of the respiration circuit is arranged under (i.e., within, or closer to the user's body than) the insulated layer of the suit and/or in contact with the active heating, if such is used, a conservation is obtained of the heat contents of the exhaled gas. Since the carbon dioxide absorber 15 is exothermic and is completely surrounded by the heat-insulation, this heat addition is used entirely for heating the breathing gas. In an emergency situation, when the active heating of the suit fails, the passive insulation, in combination with the heat from the carbon dioxide absorber is sufficient to provide 10–15 minutes within which to rescue the diver, which is a reasonable operation period for an emergency system. Furthermore the capacity of the carbon dioxide absorber increases, when the gas in the respiration circuit is kept warm. The entire personal diving equipment can be made considerably smaller and more flexible, which improves the diver's possibilities to pass through small openings.

The invention is not limited to the embodiment shown and described, but a plurality of variations are possible within the scope of the patent claims. The breathing bellows 20 can, in itself, comprise a heat insulating material or be provided with such an insulation. Even the gas container 30 for emergency situations can, if necessary, be placed within the heat-insulation of the diving suit, and possibly even within the cover 27.

I claim:

1. A heat conservation system for an underwater diving suit, comprising:

an overalls-type diving suit joined with a helmet at a neckband, said diving suit including a layer of thermal insulation for protecting a diver, while submerged, against body heat loss;

a substantially closed respiration circuit including a breathing mask disposed with the helmet, a carbon dioxide removal unit disposed outside said helmet, an exhaling hose connecting the breathing mask with an inlet side of the carbon dioxide removal unit, and an inhaling hose connecting an outlet side of the carbon dioxide removal unit with the breathing mask;

said substantially closed respiratory system, except within said helmet, being substantially enclosed within said layer of thermal insulation.

2. The heat conservation system of claim 1, wherein:

said substantially closed respiratory system further includes a breathing bellows incorporated in said exhaling hose, outside said helmet, between said breathing mask and said carbon dioxide removal unit;

said diving suit having a portion arranged to cover a corresponding portion of a diver's back, and said breathing bellows and said carbon dioxide removal unit being situated so as to be covered by said thermal insulation layer of said diving suit.

3. The heat conservation system of claim 2, wherein:

said diving suit further includes an active heating system for introducing heat, in use, into within the diving suit from outside the diving suit; and said exhaling hose and inhaling hose are spatially arranged to gain heat from said active heating system within said diving suit.

4. The heat conservation system of claim 2, wherein:

said diving suit includes a back wall from covering a corresponding portion of a diver, said breathing bellows and said carbon dioxide removal unit are externally provided on said back wall, and said diving suit further includes a removable cover covering said breathing bellows and said carbon dioxide removal unit on said back wall of said diving suit; said removable cover including a portion of said layer of thermal insulation.

5. The heat conservation system of claim 4, wherein:

said bellows has two opposite end walls, including a fixed end wall secured on said back wall of said diving suit.

6. The heat conservation system of claim 2, wherein:

said carbon dioxide removal unit comprises a cartridge in which heat is produced by an exothermic reaction as carbon dioxide is separated thereby from exhaled breathing gas expelled by a diver through said exhaling hose.

* * * * *